US005279272A

United States Patent [19]

Krüger

[11] Patent Number: 5,279,272

[45] Date of Patent: Jan. 18, 1994

[54] METHOD AND APPARATUS FOR CONTROLLING FUEL INJECTION VALVES IN AN INTERNAL COMBUSTION ENGINE

[75] Inventor: Hinrich Krüger, Braunschweig, Fed. Rep. of Germany

[73] Assignee: Volkswagen AG, Wolfsburg, Fed. Rep. of Germany

[21] Appl. No.: 61,278

[22] Filed: May 12, 1993

Related U.S. Application Data

[63] Continuation of Ser. No. 896,825, Jun. 11, 1992, abandoned.

[30] Foreign Application Priority Data

Jun. 19, 1991 [DE] Fed. Rep. of Germany ..... 4120116

[51] Int. Cl.[5] ..... F02M 51/00

[52] U.S. Cl. ..... 123/86

[58] Field of Search ..... 123/486, 480, 429; 364/431.05, 431.11

[56] References Cited

U.S. PATENT DOCUMENTS

| | | | |
|---|---|---|---|
| 4,782,806 | 11/1988 | Hatanaka | 123/486 |
| 4,850,324 | 7/1989 | Furuyama | 123/479 |
| 4,869,222 | 9/1989 | Klassen | 123/489 |
| 5,002,031 | 3/1991 | Kako | 123/486 |

FOREIGN PATENT DOCUMENTS

| | | | |
|---|---|---|---|
| 2457461 | 10/1976 | Fed. Rep. of Germany . | |
| 3434339 | 3/1986 | Fed. Rep. of Germany . | |
| 2551681 | 2/1988 | Fed. Rep. of Germany . | |
| 2709187 | 7/1988 | Fed. Rep. of Germany . | |
| 3219007 | 6/1990 | Fed. Rep. of Germany . | |
| WO91/17350 | 4/1991 | World Int. Prop. O. | 123/486 |

*Primary Examiner*—Raymond A. Nelli

*Attorney, Agent, or Firm*—Brumbaugh, Graves, Donohue & Raymond

[57] ABSTRACT

To eliminate unstable engine operation during idling of an internal combustion engine, the width of the pulses that activate the fuel injection valves for the engine are controlled in the form of ideal angles that depend on the engine-intake air flow, and the corresponding signals are related to the particular engine speed in a counter.

5 Claims, 3 Drawing Sheets

METHOD AND APPARATUS FOR CONTROLLING FUEL INJECTION VALVES IN AN INTERNAL COMBUSTION ENGINE

This application is a continuation of application Ser. No. 07/896,825, filed on Jun. 11, 1992, now abandoned.

BACKGROUND OF THE INVENTION

This invention relates to the control of fuel injection valves in an internal combustion engine based on engine crank angle and air intake signals.

German Offenlegungsschrift No. 27 09 187 discloses a fuel injection control system in which pulses from an ignition pulse generator are shaped and timed as crank angle position or angle-of-rotation signals and supplied to a multivibrator control unit. Each crank rotation of 180° provides an integrated engine speed-dependent voltage signal to a memory in the control unit. Integration is followed by discharge at a rate that depends on the rate of air intake to the engine. The control unit generates corresponding pulses that activate the fuel injection valves. Thus, the duration of the injection control pulse depends on the instantaneous engine speed and the air flow rate. Downstream from the multivibrator is a multiplier that corrects the duration of the pulse in accordance with signals from additional sensors which detect various operating parameters of the engine.

Such conventional control systems have the disadvantage that the engine speed is detected by analog loading of the memory in the control unit before the activating pulse is actually generated. Consequently, the duration of the activating pulse is based on an engine speed value that may no longer be correct. Thus, conventional injection control systems may produce a pulse that activates a downstream injection valve when the duration of the pulse, which determines how much fuel is to be injected, is partly or completely inappropriate for the engine speed at the time when the pulse is generated and the fuel is injected.

This drawback is particularly severe when an engine idling at low speed is subjected to a load. In those circumstances, conventional systems based on detection of engine speed will yield too high a result, and the duration of the valve-activating pulse will reduce the speed even though the actual speed may have already dropped subsequent to the engine speed detection because, for example, an electric load has been turned on. In the event of a misfire at this time, the engine's crankshaft and flywheel may no longer have enough kinetic energy to produce the compression required for the next cylinder and the engine will stall. Although this situation could, of course, be counteracted by increasing the prescribed idling speed, this would increase fuel consumption and could violate environmental regulations.

Such idling behavior of an internal combustion engine depends on certain conditions. Variations in motor speed during idling are due, for example, to variations in the individual burns that can even extend to misfires and to turning on and off the various electric loads in the motor vehicle containing the engine. Since the flow of combustion air through the opening of the throttle valve and into the intake manifold of the engine is hypercritical, occurring, that is, at the speed of sound, the rate of air flow will remain constant even when the engine speed changes. To attain a stable idling speed, the fuel must also be supplied at a constant rate. Because the fuel consumption of the engine during idling is proportional to engine speed even though the given fuel flow remains more or less constant, an idling speed appropriate to a prescribed fuel flow will be established regardless of whether or not the prescribed flow of air and fuel is uniformly distributed among several cylinders during a given time. Then, when a load is applied, a lower engine speed will become established at which the fuel consumption of the engine at idling plus the additional consumption due to the load will again be related to the output of the engine. The previously mentioned minimum speed at which the engine can idle without stalling occurs because the kinetic energy of the mechanism driving the crank and flywheel is proportional to the square of the speed. At some point as the speed decreases, this value will no longer be high enough to provide the compression required for the next cylinder subsequent to a misfire, for example.

The result of these circumstances is that all conventional methods and devices that rely upon fuel injection activating signals having a duration, i.e. a width measured in time, and controlled in accordance with a previously determined engine speed are unable to assure a stable idling speed at a stoichiometric air ratio.

Thus, assuming a fictional operating point with a stoichiometric proportion of air, if the air flow remains constant when an electric load is turned on or there is a misfire while the engine is idling and the quantity of air per combustion chamber increases while the flow of fuel decreases, the amount of fuel per combustion chamber will remain constant. The result is an increased air-to-fuel ratio. As a result, firing will shift into the expansion phase, the amount of work done per cylinder will decrease, and speed will decrease until the engine stops completely. On the other hand, when the speed increases, the flow of fuel will increase and the ratio of air to fuel will decrease. The speed will continue to increase until the air-to-fuel ratio has dropped to a level where it decreases the force output per cylinder.

With such conventional systems as discussed herein, an attempt has been made to establish a stable idling speed at stoichiometric air ratios by permanent readjustment of the fuel supply in response to variations in engine speed. The engine speed is continuously detected and a corresponding fuel injector-activating pulse duration is obtained from a stored graph of engine operating characteristics. The injection time is then corrected with signals from a lambda probe. The result is to produce necessarily unstable injection time readjustments as the speed decreases and the deviations in speed increase. In such conventional systems, the speed data are not available until after a delay of half a crankshaft rotation and, in the case of other control systems, until after a delay of a whole crankshaft rotation. The signal from the lambda probe is not available until considerably later, when the particular combusted mixture has arrived at the lambda probe in the exhaust line of the engine. This delay of the lambda signal is the major engine control problem in conventional systems. It is the major reason why the attainable minimal idling speed depends essentially on the control method and not on the engine itself. This is also true, by the way, when the air intake is regulated in addition to the fuel intake by controlling the cylinder intake with the engine idling.

In contrast to these conventional control systems, the control system described in German Patent No. 32 19

007 remotely detects not only the beginning but also the width of the pulses that activate the fuel injection valves. This is done with sensors, Hall generators, for example, mounted on a disk that rotates dependently of engine speed and that has two pulse generators mounted on it at prescribed angular intervals. These controls, however, operate mechanically and are not able to carry out regulation in accordance with such other parameters as temperature or signals from a lambda probe. Furthermore, the accelerator position does not provide unambiguous information about air flow in all of the operating conditions of the engine.

SUMMARY OF THE INVENTION

Accordingly, it is an object of the present invention to provide a method and apparatus for controlling fuel injection valves in an internal combustion engine which overcomes the above-mentioned disadvantages of the prior art.

Another object of the invention is to provide a method and apparatus for controlling fuel injection valves that will provide a stable idling speed even at a stoichiometric air ratio with no need for readjustment.

These and other objects of the invention are attained by generating crank angle pulses which are shorter than the injector activation pulses occurring during engine operation, producing air flow rate signals, obtaining an ideal crank angle injection duration from stored information based on the air flow rate and providing injector pulse activation signals having a width based on the instantaneous engine speed from a comparison of the ideal angle with the instantaneous speed.

The invention differs in its overall concept from the prior art. A pulse for activating the injection valves is no longer delayed by a specific time interval after the determination of engine speed. Engine speed is not even actually measured. The width of the pulses depends on the angle of rotation of the crankshaft. The aforesaid signal delay and all its drawbacks is eliminated, and this is done with a technically simple arrangement. The angle-of-rotation signals can be obtained with the angle sensor that is already present for obtaining signals for the ignition system of the engine, for example. Furthermore, with the engine idling and the air flow constant, a constant mean fuel flow rate can be assured.

In previously installed control systems the advantages of the invention can be obtained by providing activating pulse angles from stored ideal angles only when the engine is idling.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
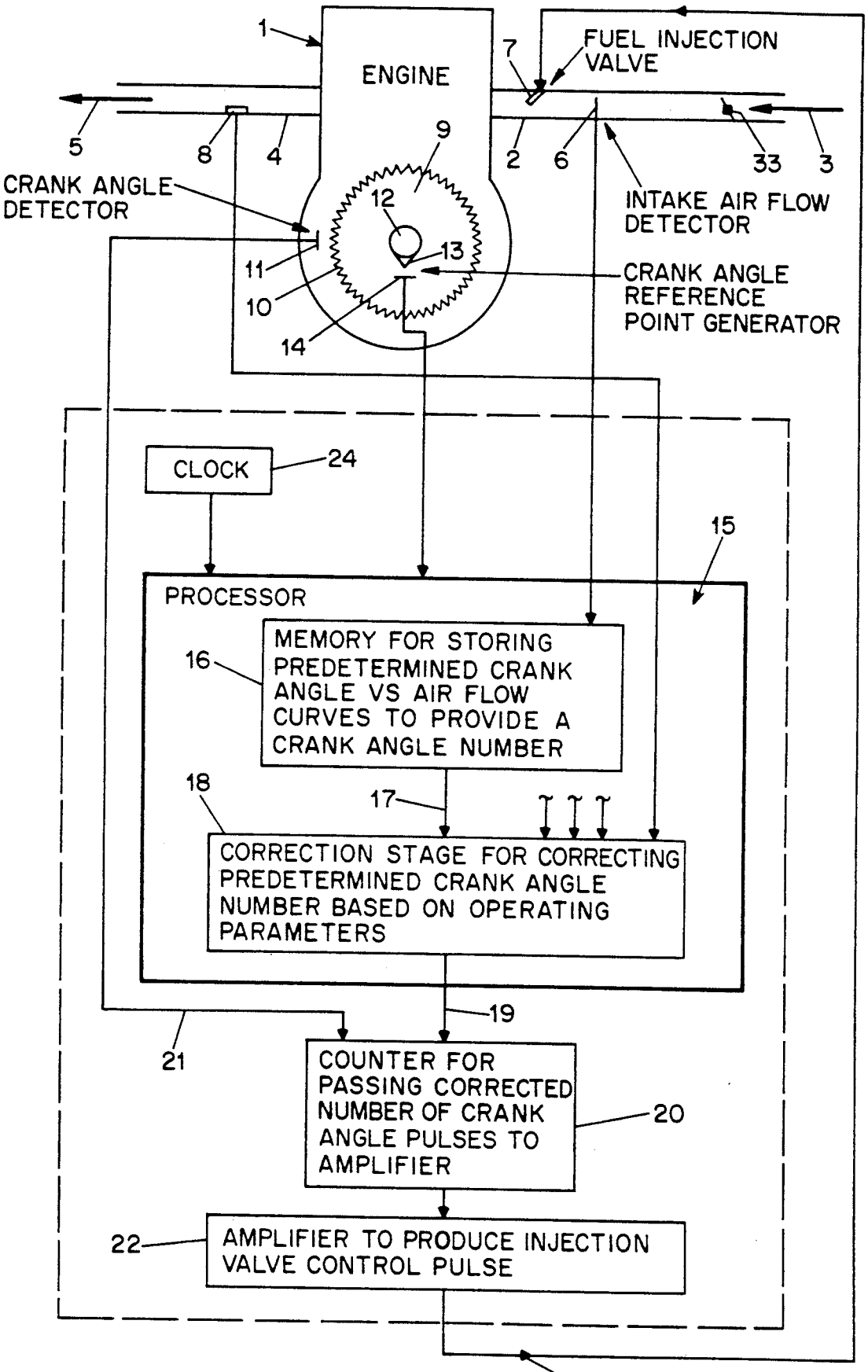
FIG. 1 is a schematic block diagram illustrating the arrangement of a representative embodiment of a fuel injection valve control system arranged in accordance with the invention.

In the typical embodiment of the invention shown in FIG. 1, an internal combustion engine 1, which can be an Otto or Diesel engine, has an intake manifold 2 that is supplied with combustion air 3 by suction or by a conventional supercharger, and an exhaust manifold 4 that collects exhaust gas 5 and releases it into the atmosphere. The intake manifold 2 contains a sensor 6 for detecting the rate of flow of combustion air, which may be a dynamic pressure-activated disk, for example, and includes a fuel injection valve 7 for each cylinder. The purpose of the control system of the invention is to generate control pulses for activating the fuel injection valves. It is, of course, also possible to provide one valve for several cylinders.

The exhaust manifold contains a lambda sensor 8 to detect the air ratio.

Also included in the engine 1 is a flywheel 9 which is provided with a series of magnetic asymmetries 10 for at least the range of adjustment presently of interest, the range relating to the width of the pulses that activate the valve 7. The crank angle or crank rotation is detected by motion of the asymmetries under an inductive signal generator 11. Mounted on a camshaft 12 is a reference-point 13 in the form of a cog associated with reference-point generator 14. All of the foregoing sensors and generators are of conventional design and need not be described in detail herein.

The signals from the generator 14 are transmitted as starting information to a processor 15. The processor 15 contains a curve memory 16 that stores the relationship between the instantaneous air flow detected by the sensor 6 and the corresponding width of the pulse for activating the valve 7. The curve memory 16 transmits the pulse width in the form of an ideal crank angle of rotation in accordance with the instantaneous flow of air, and specifically in the form of the number of generator pulses, at its output terminal 17. That output signal is corrected in a correction stage 18 based on various engine parameters, temperature and signals from a lambda probe, for example, and transmitted to an input terminal 19 of a counter 20. Associated with the processor 15 is a clock 24 that produces clock pulses at any desirable rate independent of engine speed.

It is essential to the invention that the processor 15 does not take into account in any way the current engine speed. Only the instantaneous rate of air flow is detected by the sensor 6 and an activating pulse width, specifically a crank angle which is ideal for that air flow, is derived from the stored curve. The crank angle is then transmitted by a line 17 to the correction stage 18 in the form of a specific number of signals or pulses. A corrected ideal crank angle is forwarded from the correction stage 18 to the input terminal 19 of the counter 20 in the form of a specific number of signals assigned to that angle.

The counter 20 then establishes a relationship between the signals leaving the processor 15 and the instantaneous engine speed as determined by the signals from the angle sensor 11. A prerequisite, of course, is the generation of a series of angle signals with a high enough resolution to insure that the angular increments between signals will be smaller than the minimal angle-associated width of the pulses that activate the injection valves.

Specifically, this conversion is accomplished by loading the counter 20 with the number of signals on the line 19 and by detecting the same number of angle signals at the input 21. As this counting procedure commences, a pulse is generated that is amplified in a signal amplifier 22 to produce the pulse 23 that activates a valve 7. The pulse terminates when the counting is completed.

Since all the components of this system are in themselves known, they need not be described in detail herein. It is essential to the invention that the engine speed itself is never actually measured and that no times are stored in the memory 16 to represent ideal pulse width. All that is employed is the engine speed, and that is used only indirectly and not until the end of the procedure at the instant an activating signal 23 is obtained, specifically from the counter 20. This situation is also represented by the formulas shown in the boxes in FIG. 1, wherein $\alpha_E$ represents the ideal angle, $m_L$ is the air flow, and K is a factor employed to correct signals from such various other sensors as a lambda probe or temperature sensors. It will be evident that the counter 16 and the correction stage 18 operate strictly in terms of the angle of crank rotation and that the engine speed n, and hence time, plays no part upstream of the counter 20. Accordingly, the width of the pulses 23 that activate the injection valve 7 are proportional to the mass air flow $m_L$ and the constant K and are inversely proportional to the speed n. The engine speed signals can also be modified by components that dictate another functional relationship between the pulse width and the engine speed, if desired.

Figure 2:
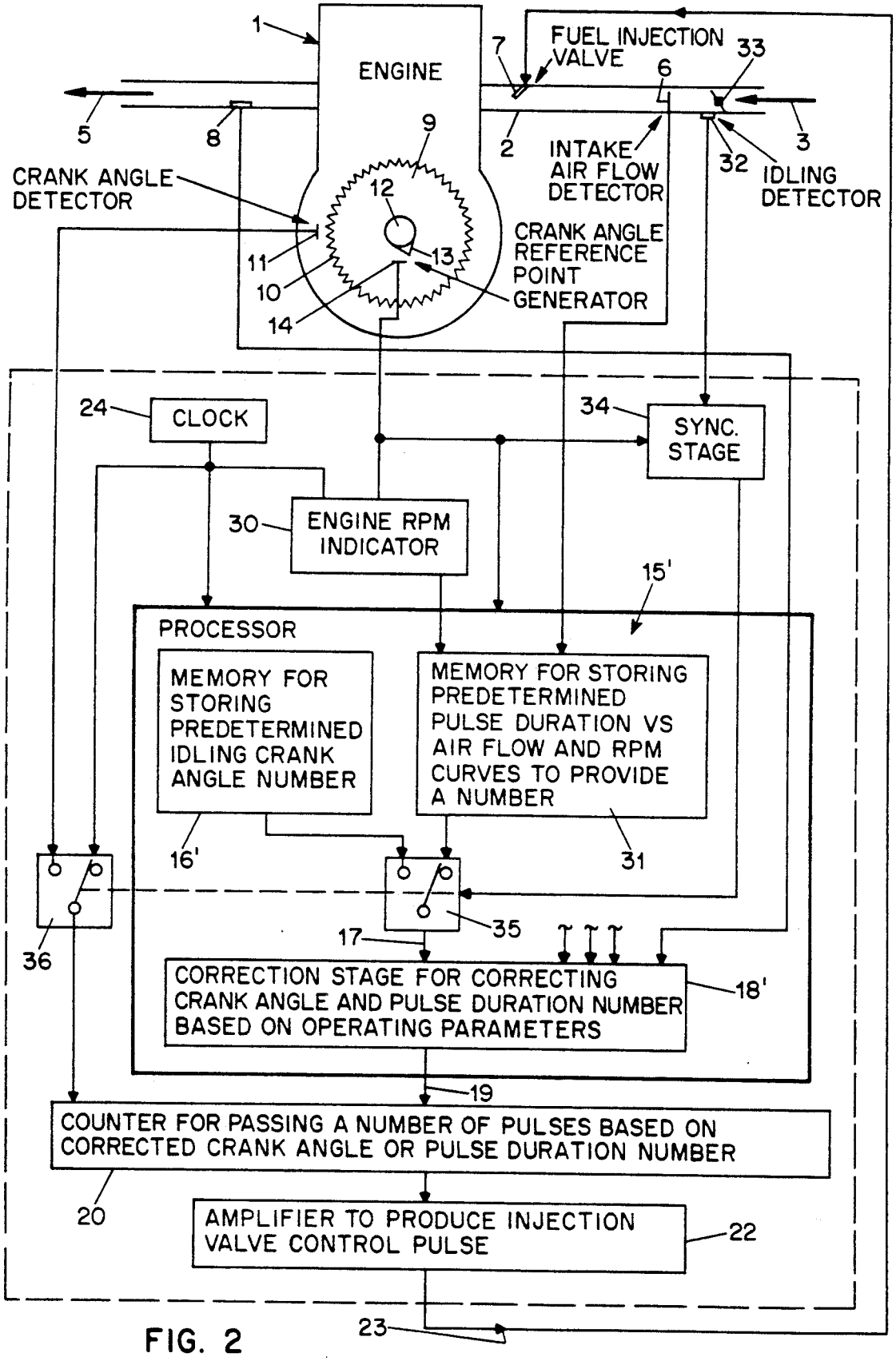
FIG. 2 is a schematic block diagram illustrating an arrangement for converting a conventional control system to carry out the method of the invention when the engine is idling.

The typical embodiment of the invention illustrated in FIG. 2 is intended to be used when a conventional device for detecting the pulses that activate the injection valves in accordance with time is converted for purposes of refitting, for example, to utilize the method of the invention at idling speed. Components identical with those illustrated in FIG. 1 are labelled with the same reference numbers, and modified components are labelled with the same numbers primed.

The portion of the overall system adapted from a conventional system comprises an engine speed indicator 30 that is controlled by the reference-point generator 14 and enters engine speed signals into a characteristic-graph memory 31 in a processor 15'. Signals from the air-flow sensor 6 are also forwarded to the characteristic-graph memory 31, which also contains ideal pulse durations $t_E$ as a function of air flow $m_L$ and engine speed n. A switch 35 is controlled by an idling contact 32 on a throttle flap 33 by way of a synchronization stage 34. The switch 35 will remain in its illustrated position as long as the engine 1 is not idling. A series of signals representing this duration $t_E$ is transmitted to the correction stage 18'. The stage 18' corrects the output from the switch as indicated by factor K with respect to actual temperatures, lambda-probe results, etc. The corrected ideal pulse durations from the counter 20 are amplified in the signal amplifier 22 and forwarded in the form of activating signals 23 to the valves 7. The timing signals from the clock 24 in the processor 15' are simultaneously forwarded to the counter 20 by way of a switch 36 that is connected to the switch 35. The rate of the timing signals is accordingly independent of the actual speed of the engine, which has already been accounted for when the ideal duration $t_E$ was extracted from the characteristic-graph memory 31.

The operation of the system illustrated in FIG. 2 with the engine subject to load, that is, with the throttle flap 33 open, has just been explained.

With the engine idling and with the throttle flap 33 closed, the aforesaid approach, which includes detecting the speed n while the crankshaft is rotating and prior to actual determination of the duration of the pulses that activate the fuel injection valves, leads to the aforesaid drawbacks which involve a time delay. The idling contact 32 will accordingly now shift the switches 35 and 36 into the unillustrated position, activating the memory 16' and forwarding the angle signals from the generator 11 to the counter 20. The memory 16' is the characteristic-curve memory 16 illustrated in FIG. 1 modified to the extent that it contains only a single constant, an ideal angle $\alpha_E$ with a value A. This is because the very low pressure in the intake pipe 2 while the engine is idling and the throttle flap 33 is closed results in a hypercritical flow rate and hence produces a constant air flow $m_L$. The ideal angle A is also multiplied in the correction stage 18' by the previously discussed factor K and transmitted to the counter 20 which now processes the particular speed as explained with reference to FIG. 1.

Figure 3:
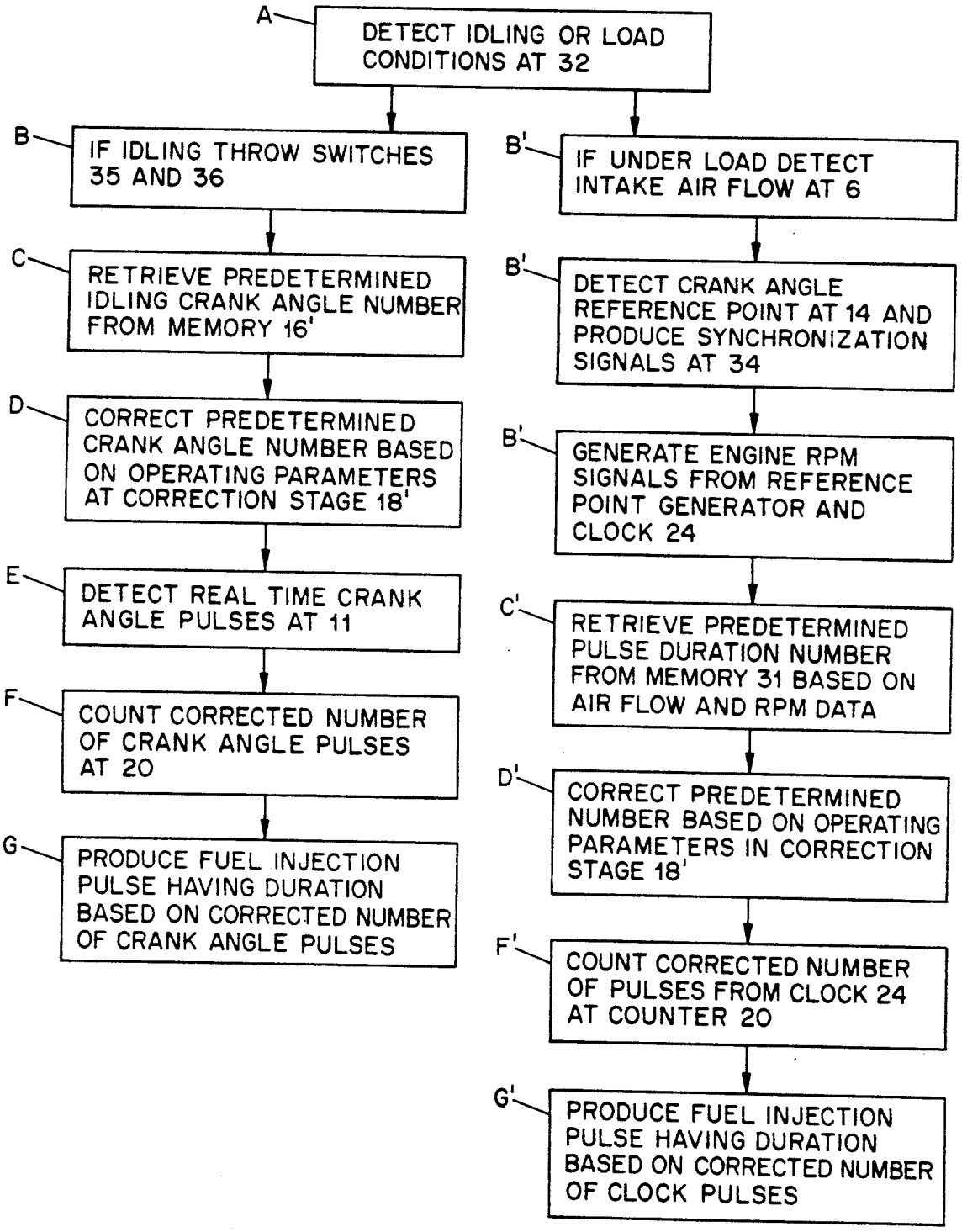
FIG. 3 is a schematic flow diagram showing the sequence of steps involved in the operation of the fuel injection valve control system illustrated in FIG. 2.

FIG. 3 is a flow diagram illustrating the steps involved in the operation of the system shown in FIG. 2 and previously described. As indicated at Step A in FIG. 3, the idling contact 32 detects whether the engine is idling or under load. If the engine is idling, Steps B through G are followed and, as shown at Step B, the switches 35 and 36 are actuated, connecting the crank angle detector 11 to the counter 20, and the idling crank angle number memory 16' to the correction stage 18'. The processor 15' then retrieves a predetermined idling crank angle number from the memory 16', as shown at Step C, and that number, transmitted through the switch 35, is corrected at the correction stage 18' based on operating parameters of the engine and the corrected number is passed to the counter 20. The counter 20 then counts a number of pulses from the crank angle detector 11 corresponding to the corrected number received from the correction stage as indicated in Step F and that number of pulses is passed to the amplifier 22 to produce a fuel injection pulse having a duration based on the corrected number as indicated in Step G.

If the engine is operating under load, the system follows the Steps B', B1', B2', C', D', F' and G', as shown in FIG. 3, first detecting the intake air flow at the detector 6 as indicated in Step B' and detecting the crank angle reference point at 14 to produce synchronization signals at the synchronization stage 34 as shown in Step B1'. In addition, engine RPM signals are generated from the reference point generator 14 and the clock 24 as shown in Step B2' and supplied to the memory 31 as indicated in Step C'. A predetermined pulse duration number is retrieved from the memory 31 based on the RPM data and the air flow data received from the detector 6. In Step D', the predetermined pulse duration number is corrected based on engine operating parameters in the correction stage 18' and, as shown at Step F', the counter 20 counts a number of pulses from the clock 24 corresponding to the corrected number received from the correction stage and, as shown in Step G', the amplifier 22 produces a fuel injection pulse having a duration based on the corrected number of clock pulses.

Thus, as discussed above, the system of the present invention avoids the problems which can result from attempts to rely upon intake air flow data to control the duration of fuel injection pulses during idling as well as during operation under load by providing a separate source of fuel injection control pulses independent of intake air flow when the engine is in the idling condition.

As will also be evident from the absence of relevant restrictions from the foregoing description of embodiments, the application of the measures in accordance with the invention does not depend on specific injection principles, such as one or more injections per operating cycle or per engine rotation. The invention can in fact be employed with either central injection, , into an intake manifold common to all the cylinders, or multiple-point injection into each individual cylinder. In the latter case, it makes no difference whether the injection times are identical or are regulated cylinder by cylinder.

Accordingly, the invention provides volumetric injection control that will insure a highly stable engine idling speed.

Although the invention has been described herein with reference to specific embodiments, many modifications and variations therein will readily occur to those skilled in the art. Accordingly, all such variations and modifications are included within the intended scope of the invention.

I claim:

1. A method for controlling the operation of fuel injection valves in an internal combustion engine, both during idling and when the engine is operating under load, comprising detecting the flow of combustion air to the engine, detecting the engine RPM, generating a first signal corresponding to a first number related to fuel injection duration based on predetermined pulse duration information stored in a memory, using the first signal to count a corresponding number of pulses to control the duration of operation of a fuel injection valve when the engine is operating under load, generating a second signal corresponding to a second number based on predetermined stored idling operation of the engine stored in another memory and using the second signal to count a corresponding number of pulses to control the duration of operation of the fuel injection valve when the engine is idling.

2. A method according to claim 1 including correcting the first and second signals used to control the duration of operation of the fuel injection valve in accordance with operating parameters of the engine.

3. A method according to claim 1 wherein the first number is based on stored predetermined pulse duration versus air flow and RPM curves and the second number is based on stored predetermined idling crank angle information.

4. Apparatus for controlling the operation of fuel injection valves in an internal combustion engine both during idling and when the engine is operating under load including an internal combustion engine having a crankshaft and comprising a reference point signal generator for generating a signal indicating each crankshaft cycle, a crank angle detector for continuously generating signals representing the instantaneous angular position of the crankshaft, an intake air flow detector for detecting the flow of combustion air supplied to the engine, an engine RPM indicator for generating signals representing the engine RPM, a processor containing a characteristic curve memory responsive to signals from the intake air flow detector and the engine RPM indicator for producing a first number signal corresponding to the duration of operation of a fuel injection valve when the engine is operating under load, a second memory in the processor for producing a second number signal corresponding to the duration of fuel injection valve operation when the engine is idling, a counter for selectively counting crank angle detector signals corresponding to the second number to control the operation of a fuel injection valve when the engine is idling and for counting a number of clock signals corresponding to the first number for controlling the operation of the fuel injection valve when the engine is operating under load.

5. Apparatus according to claim 4 wherein the processor includes a correction stage for correcting the first and second number signals based on engine operating parameters and supplying the corrected signals to the counter.

* * * * *